US007434283B2

(12) United States Patent
Wilkinson et al.

(10) Patent No.: US 7,434,283 B2
(45) Date of Patent: Oct. 14, 2008

(54) DISCRETE CELL BODY SUPPORT AND METHOD FOR USING THE SAME TO PROVIDE DYNAMIC MASSAGE

(75) Inventors: John W. Wilkinson, Lady Lake, FL (US); John C. Wilkinson, Hoosick Falls, NY (US)

(73) Assignee: M.P.L. Limited, Belize (BZ)

( * ) Notice: Subject to any disclaimer, the term of this patent is extended or adjusted under 35 U.S.C. 154(b) by 272 days.

(21) Appl. No.: 11/056,686

(22) Filed: Feb. 11, 2005

(65) Prior Publication Data

US 2005/0177952 A1 Aug. 18, 2005

Related U.S. Application Data

(60) Provisional application No. 60/544,366, filed on Feb. 13, 2004.

(51) Int. Cl.
*A47C 27/10* (2006.01)
*A47C 27/08* (2006.01)

(52) U.S. Cl. ..... 5/713; 5/710

(58) Field of Classification Search ..... 5/713, 5/710, 706, 655.3, 654, 644, 925, 926
See application file for complete search history.

(56) References Cited

U.S. PATENT DOCUMENTS

| | | | | |
|---|---|---|---|---|
| 201,728 | A | 3/1878 | White | 5/707 |
| 3,653,083 | A | 4/1972 | Lapidus | 5/713 |
| 4,477,935 | A | 10/1984 | Griffin | 5/241 |
| 4,488,322 | A | 12/1984 | Hunt et al. | 5/713 |
| 4,605,582 | A | 8/1986 | Sias et al. | 428/120 |
| 4,644,597 | A | 2/1987 | Walker | 5/711 |
| 4,662,012 | A | 5/1987 | Torbet | 5/713 |
| 4,686,722 | A | 8/1987 | Swart | 5/713 |
| 4,797,962 | A | 1/1989 | Goode | 5/713 |

(Continued)

FOREIGN PATENT DOCUMENTS

EP 0 302 579 A1 2/1989

(Continued)

OTHER PUBLICATIONS

AccuMax Self Adjusting Pressure Management Systems, Copyright1998 BG Inudstries.

*Primary Examiner*—Robert G Santos
(74) *Attorney, Agent, or Firm*—Schmeiser, Olsen & Watts

(57) ABSTRACT

A mattress or another type of support surface which allows for discrete manipulation of the pressure on a supported body. The present invention includes resilient fluid cells having a spring bias, grouped to allow adjustable dynamic control of the pressure exerted on various locations of the body support. Each of the fluid cells has a multiple port air distribution system, either integral to the fluid cell or attached to the fluid cell. The multiple port air distribution system includes ports and allows for the control of intake flow, outflow, and sound. A harnessing system is attached to the ports of the multiple port air distribution system and interconnects the fluid cells in a pattern desired by the user. The harnessing system controls the directions and flow volume of air into the fluid cells creating selected zones. The harnessing configuration is customizable to a particular patient. The fluid cells are held together by a casing. The casing supports, houses, and prevents movement of the fluid cells and the harnessing system.

72 Claims, 14 Drawing Sheets

U.S. PATENT DOCUMENTS

| | | | | | |
|---|---|---|---|---|---|
| 4,852,195 | A | * | 8/1989 | Schulman | 5/713 |
| 4,908,895 | A | | 3/1990 | Walker | 5/711 |
| 4,989,283 | A | | 2/1991 | Krouskop | 5/713 |
| 5,020,176 | A | | 6/1991 | Dotson | 5/710 |
| 5,023,967 | A | | 6/1991 | Ferrand | 5/607 |
| 5,033,133 | A | | 7/1991 | Nissen | 5/653 |
| 5,051,673 | A | | 9/1991 | Goodwin | 318/481 |
| 5,070,560 | A | | 12/1991 | Wilkinson | 5/710 |
| 5,090,076 | A | | 2/1992 | Guldager | 5/713 |
| 5,090,077 | A | | 2/1992 | Caden et al. | 5/713 |
| 5,109,561 | A | | 5/1992 | Schild | 5/713 |
| 5,111,544 | A | * | 5/1992 | Graebe | 5/654 |
| 5,142,717 | A | | 9/1992 | Everard et al. | 5/709 |
| 5,249,318 | A | | 10/1993 | Loadsman | 5/710 |
| 5,267,364 | A | | 12/1993 | Volk | 5/713 |
| 5,375,273 | A | | 12/1994 | Bodine, Jr. et al. | 5/710 |
| 5,388,292 | A | | 2/1995 | Stinson et al. | 5/682 |
| 5,487,196 | A | | 1/1996 | Wilkinson et al. | 5/715 |
| 5,539,942 | A | | 7/1996 | Melou | 5/655.3 |
| 5,542,136 | A | | 8/1996 | Tappel | 5/710 |
| 5,560,057 | A | | 10/1996 | Madsen et al. | 5/715 |
| 5,584,085 | A | | 12/1996 | Banko | 5/710 |
| 5,586,346 | A | | 12/1996 | Stacy et al. | 5/710 |
| 5,594,963 | A | | 1/1997 | Berkowitz | 5/713 |
| 5,611,096 | A | | 3/1997 | Bartlett et al. | 5/617 |
| 5,630,237 | A | | 5/1997 | Ku | 5/420 |
| 5,634,224 | A | | 6/1997 | Gates | 5/709 |
| 5,634,225 | A | | 6/1997 | Miller, Sr. et al. | 5/710 |
| 5,659,908 | A | | 8/1997 | Nishino | 5/676 |
| 5,787,531 | A | | 8/1998 | Pepe | 5/710 |
| 5,794,288 | A | | 8/1998 | Soltani et al. | 5/713 |
| 5,873,137 | A | | 2/1999 | Yavets-Chen | 5/713 |
| 5,893,184 | A | | 4/1999 | Murphy | 297/452.41 |
| 5,963,997 | A | | 10/1999 | Hagopian | 5/654 |
| 5,983,429 | A | | 11/1999 | Stacy et al. | 5/713 |
| 6,014,784 | A | | 1/2000 | Taylor | 5/713 |
| 6,092,249 | A | | 7/2000 | Kamen et al. | 5/653 |
| 6,223,369 | B1 | | 5/2001 | Maier et al. | 5/713 |
| 6,269,505 | B1 | | 8/2001 | Wilkinson | 5/713 |
| 6,349,439 | B1 | * | 2/2002 | Cook et al. | 5/713 |
| 6,367,106 | B1 | * | 4/2002 | Gronsman | 5/709 |
| 6,370,716 | B1 | | 4/2002 | Wilkinson | 5/715 |
| 6,564,411 | B2 | * | 5/2003 | Pirzada | 5/713 |
| 6,694,556 | B2 | * | 2/2004 | Stolpmann | 5/710 |
| 6,711,771 | B2 | * | 3/2004 | Cook et al. | 5/713 |
| 6,826,795 | B2 | * | 12/2004 | Wilkinson | 5/713 |
| 6,922,862 | B1 | * | 8/2005 | Thompson | 5/691 |
| 7,086,104 | B1 | * | 8/2006 | Tsay | 5/655.3 |
| 2001/0023511 | A1 | * | 9/2001 | Wilkinson | 5/713 |
| 2002/0116766 | A1 | * | 8/2002 | Stolpmann | 5/710 |
| 2003/0024051 | A2 | * | 2/2003 | Wilkinson | 5/713 |
| 2003/0208849 | A1 | * | 11/2003 | Wilkinson | 5/713 |
| 2004/0068801 | A1 | * | 4/2004 | Wilkinson | 5/713 |
| 2005/0125905 | A1 | * | 6/2005 | Wilkinson | 5/713 |
| 2005/0177952 | A1 | * | 8/2005 | Wilkinson et al. | 5/713 |
| 2007/0186349 | A1 | * | 8/2007 | Lipman et al. | 5/713 |

FOREIGN PATENT DOCUMENTS

| | | |
|---|---|---|
| EP | 0 812 555 A2 | 12/1997 |
| WO | 94/10881 | 5/1994 |

* cited by examiner

DISCRETE CELL BODY SUPPORT AND METHOD FOR USING THE SAME TO PROVIDE DYNAMIC MASSAGE

CROSS REFERENCE TO RELATED APPLICATIONS

The present application claims the benefit of Provisional Patent Application Ser. No. 60/544,366, filed Feb. 13, 2004 by the present inventor.

FIELD OF THE INVENTION

The present invention relates generally to a body support or another type of support surface which allows for discrete manipulation of the pressure on a body. In particular, the present invention includes fluid cells that are resilient, grouped to allow discrete control of the pressure exerted on a body.

BACKGROUND OF THE INVENTION

A person confined to a surface for extended periods of time often suffers from the effects of excess pressure transmitted to their bodies. Continuous pressure applied to a body can cause soft tissue damage. When the external pressure exerted on the skin causes blood carrying capillaries to close, soft tissue degeneration may occur. This soft tissue damage may lead to the formation of pressure sores. For example, continuous pressure applied to a person's heel can cause a pressure sore to develop on the heel. Thus, a need exists to address the problems heretofore discussed.

SUMMARY OF THE INVENTION

The present invention provides a cushioning device for a mattress, seat, or sofa, for example, in the medical, consumer, transportation, or hospitality industry, where support is obtained from a fluid such as atmospheric air. The body support apparatus requires minimal maintenance and is easily repairable. The body support apparatus of the present invention includes self-inflating fluid cells and a harnessing system which allows for the creation of pressure zones within the body support. The fluid cells may be enclosed in a base housing, or casing, which receives the fluid cells and affixes the cells together to form a mattress, seat, or sofa construct. The fluid cells within the casing are regulated by the harnessing system that controls and facilitates the direction and flow volume of air between the fluid cells.

The support system apparatus includes at least one support cell, such as a self-inflating fluid cell, for providing lifting support for a body. Each support cell contains a fluid. Application of an external load on an outer surface of the fluid cell causes the fluid cell to deform into a compressed form. The support cell is capable of reforming, to return the fluid cell to its original unloaded form. The support cell may be made from a molded plastic or flexible resin formed into a pod- or cartridge-like structure having a helical pattern on its outer construct, however, other resilient means can be used.

A multiple port air distribution system including ports attached to the fluid cell may be included for each fluid cell. The multiple port air distribution system will control the intake, exhaust, and allow interconnection of the fluid cells via the harnessing system.

A first general aspect of the present invention provides a body support apparatus for discrete manipulation of pressure on a body comprising:

a plurality of self-inflating fluid cells affixed together to form a support surface, wherein each of said plurality of self-inflating fluid cells has at least one port, an exterior, and an interior, and wherein said interior is defined by an open area for receiving fluid; and a harnessing system that controls the direction and flow volume of fluid into the self-inflating fluid cells such that the pressure in one or a group of the plurality of self-inflating cells may be discretely controlled.

A second general aspect of the present invention provides a method of manipulating the pressure on a body comprising:

providing a support apparatus having a plurality of molded air springs, wherein each of said molded air springs has an exterior configured to reform said molded air spring;

attaching a harnessing system to-said plurality of molded air springs, wherein said harnessing system includes conduits that interconnect the plurality of molded air springs to create a first harnessing configuration, wherein said first harnessing configuration includes a plurality of pressure zones;

selectively manipulating the pressure on a body on the support apparatus by selectively filling at least one of said plurality of pressure zones.

A third general aspect of the present invention provides a body support apparatus for discrete manipulation of the pressure on a body comprising:

a plurality of non-foam cartridges, wherein each said non-foam cartridge has a spring bias to reform said non-foam cartridge;

a multiple port air distribution system for each non-foam cartridge including at least two ports;

a casing adapted to receive said fluid cell, wherein said casing affixes said non-foam cartridges together to form a support surface; and a harnessing system that controls the direction and flow volume of air into the non-foam cartridges, wherein said harnessing system is attached to the multiple port air distribution system of each of said non-foam cartridges of said plurality of non-foam cartridges.

A fourth general aspect of the present invention provides a cushioning device comprising:

at least one air spring having an exterior, an interior, an inlet port and an exhaust port, wherein said interior is defined by an open space for receiving fluid, and wherein said exterior has a spring bias to reform said air spring;

a support surface including a first support zone and a second support zone, wherein each support zone includes at least one air spring;

a fluid supply reservoir;

a first check valve between said fluid supply reservoir and an inlet port of at least one of said air springs in each of said plurality of pressure zones, such that fluid will only be able to flow into said air spring;

a controllable pressure relief valve, wherein said controllable pressure relief valve is operatively attached to the exhaust port of at least one air spring in each of said plurality of pressure zones:

a second check valve between said exhaust port and said controllable pressure relief valve, such that fluid is prevented from entering said exhaust port; and a pressure control system which allows for individual manipulation of said support zones.

BRIEF DESCRIPTION OF DRAWINGS

Some of the embodiments of this invention will be described in detail, with reference to the following figures, wherein like designations denote like members, wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

Figure 1:
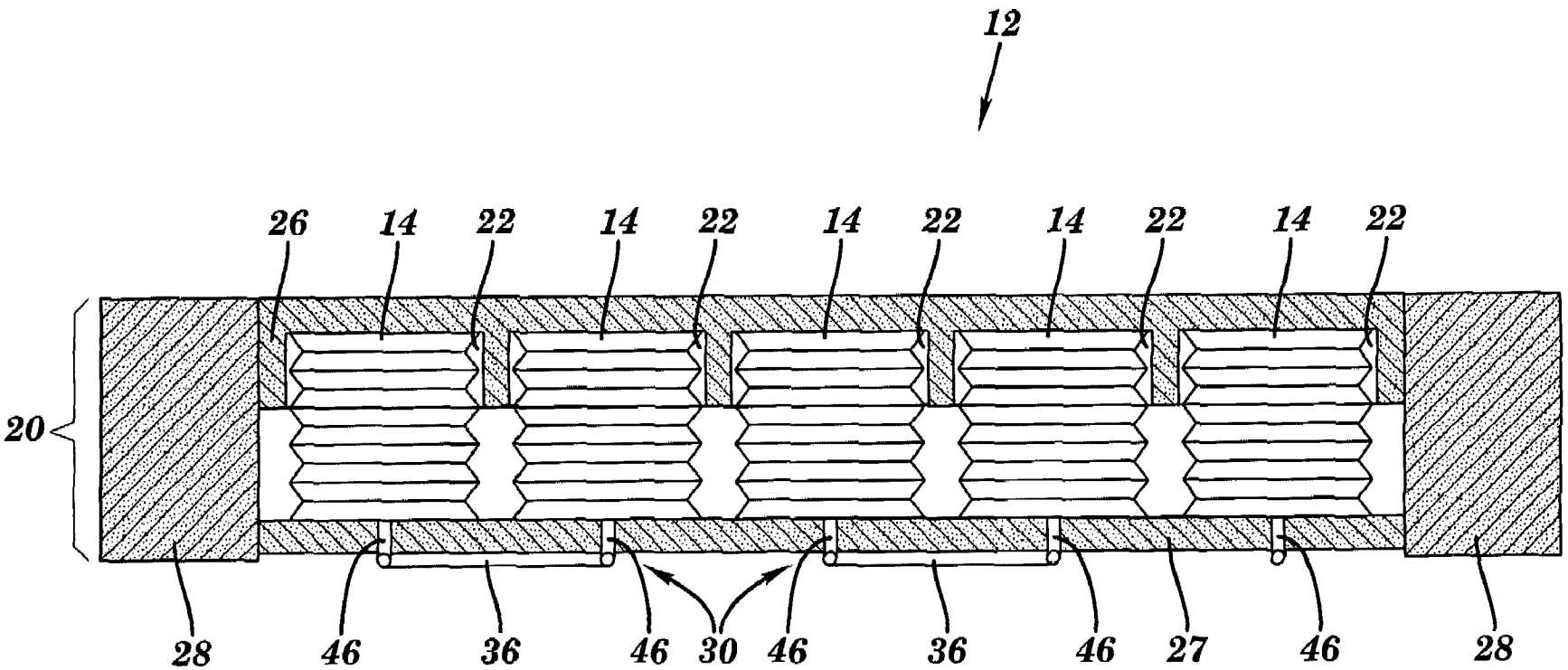
FIG. 1 illustrates a side view of an embodiment of the spring biased fluid cells interconnected with a harnessing system and installed in a casing.
Figure 14:
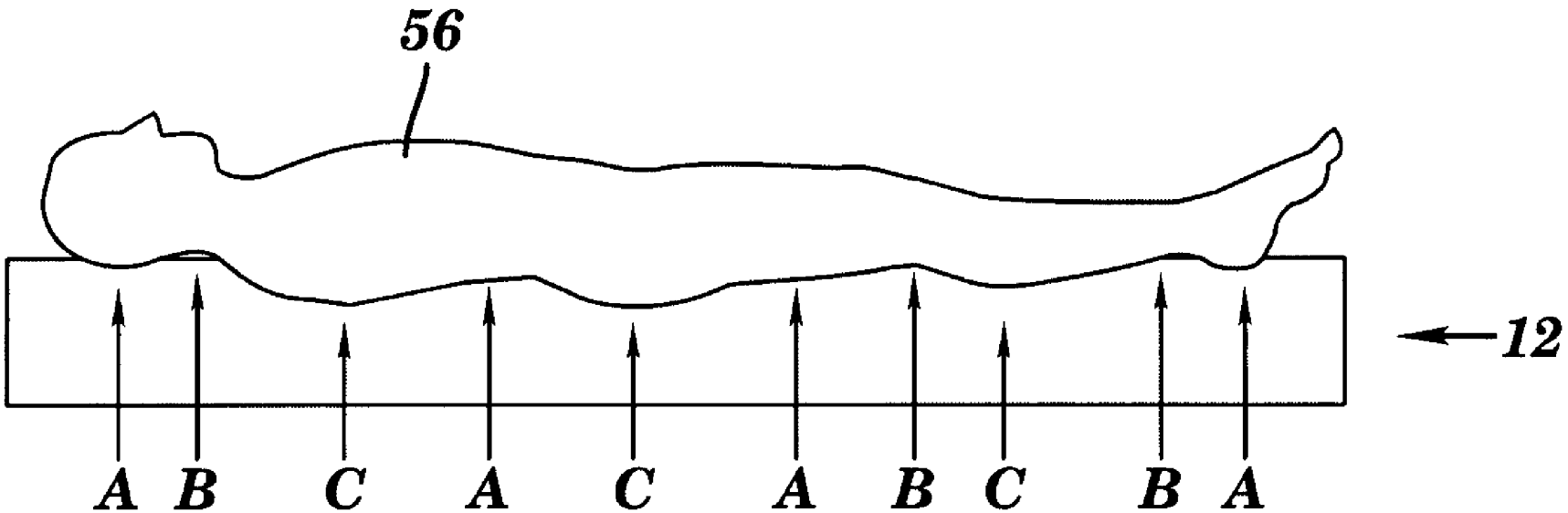
FIG. 14 illustrates a cross-sectional view of a person lying on the mattress.

FIG. 1 shows a first embodiment a body support apparatus 12 of the present invention. The body support apparatus 12 is for discrete manipulation of pressures on a body. The manipulation may be such that the body support apparatus 12 provides the body with dynamic massage of the whole body or specific parts of the body. In other words, portions of the apparatus 12 can be discretely controlled to manipulate the pressure on individual parts of a body 56 supported on the body support apparatus 12 as shown in FIG. 14. The body support apparatus 12 can be used in combination with any support device where dynamic pressure control or manipulation of a person such as a patient 56 is required. For example, the body support 12 may include a mattress, sofa, seat, etc. or may be used in conjunction with a bed, sofa, seat, etc. The body support apparatus 12 shown in FIG. 1 includes a plurality of self-inflating fluid cells 14 affixed together to form a support surface, wherein each of said plurality of self-inflating fluid cells 14 has at least one port 46, an exterior 560, and an interior 562 (FIG. 7), and wherein said interior 562 is defined by an open area, or air space, for receiving fluid, which may be air. In addition, the body support apparatus 12 has a harnessing system, or manifold system, 30 that controls the direction and flow volume of air into the self-inflating fluid cells 14 such that the pressure in one or a group of the plurality of self-inflating cells may be discretely controlled. The harnessing system, or manifold system, 30 may be operatively attached to the ports of an interconnected group of self-inflating fluid cells of the plurality of self-inflating fluid cells.

Figure 2:
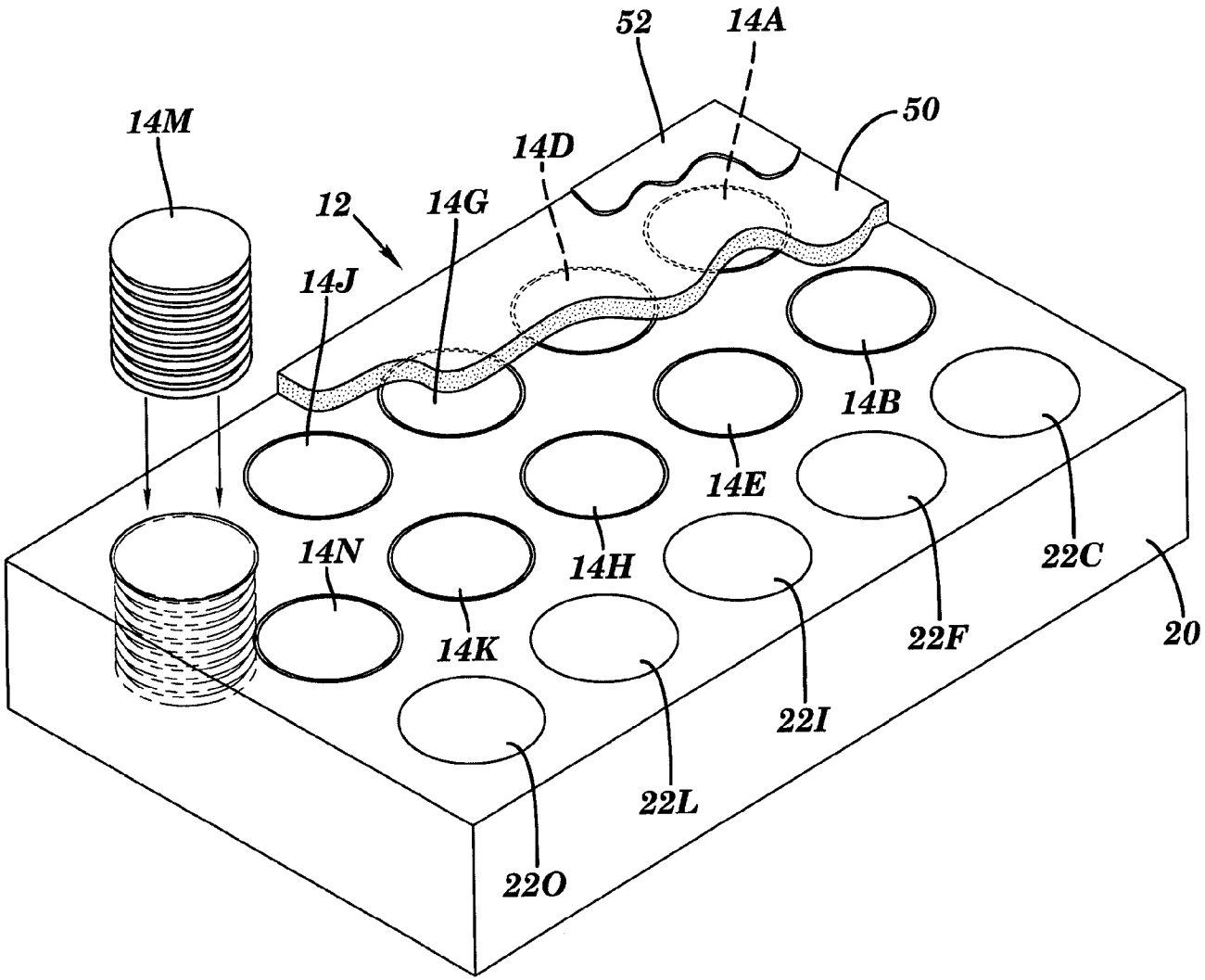
FIG. 2 illustrates a perspective view of a cushioning device in accordance with an embodiment of the present invention.

The support system apparatus 12 includes at least one self-inflating fluid cell, or reforming element, 14 such as an air spring, pod, or cartridge, having a spring bias, 14 for providing lifting support and discrete manipulation of a patient 56. As shown in FIG. 2, the greater the number of fluid cells 14, the greater the dynamic response will be to a weight or load. The fluid cells 14 are preferably constructed such that several fluid cells 14 are utilized to form a matrix in the body support 12 or such that the body support 12 includes a sufficient number of fluid cells 14 to allow for manipulation of specific parts of the body or pressure on a specific part of the body. The ability to manipulate pressures on specific parts of the body on the support 12 is dependent on the number of fluid cells 14 that are present and will typically improve when the number of fluid cells 14 is increased. For example, there can be at least three fluid cells 14 across the portion of the support 12 which would support a person's back so that when the fluid cells 14 are manipulated, discrete control of pressure in the fluid cells 14 would transfer to discrete manipulation of pressure on the body on the support 12. If, for example, ten, fluid cells 14 were present across the portion of the support which would support a person's back, the manipulation of the pressure on the back could be more discretely managed than if there were only three fluid cells.

Figure 3A:
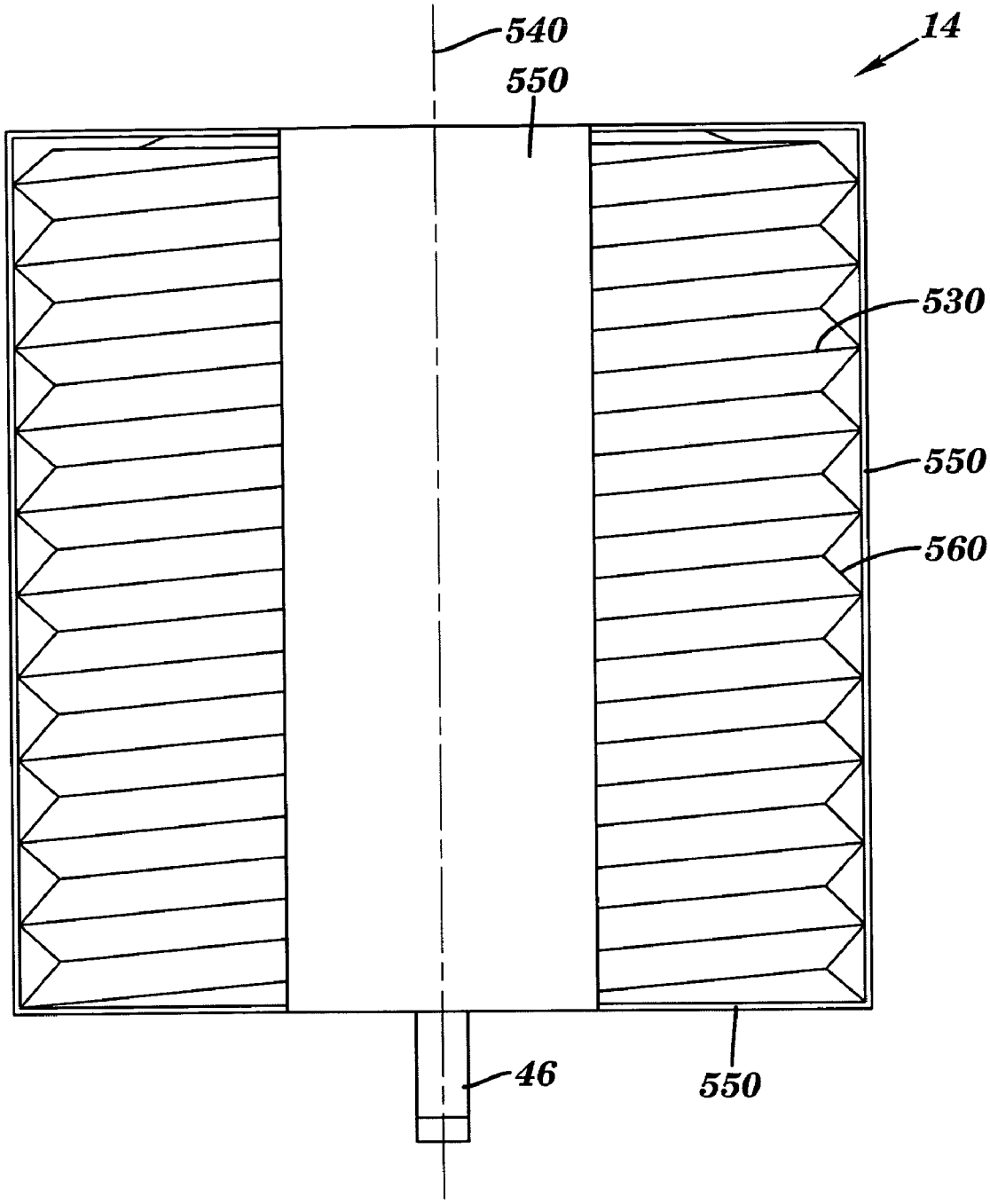
FIG. 3A illustrates a side view of one embodiment of a fluid cell including the double-helix construction, single port, and an entrapment device.

FIG. 3A illustrates a side view of a typical fluid cell 14 having a double helical pattern 530, a vertical rotational axis 540, and a single port 40. The fluid cells 14 may have a single helical pattern or a double helical pattern. However, the fluid cell 14 may also be any fluid cell which has a spring bias which effects the reformation of the fluid cell 14 such that the fluid cell 14 collapses when loaded with a load having a force which is greater than the sum of the forces within the fluid cell 14, including the pressure of the fluid inside the fluid cell 14 multiplied by the area of the fluid cell 14 supporting the load, plus the reforming force of the fluid cell 14, and said fluid cell 14 reforms when said load is reduced to a load having a force which is less than the sum of the force within the fluid cell and the reforming force of the fluid cell 14. In other words, the fluid cell acts as a reforming element such that once the fluid cell 14 is compressed with the weight of a person or article, the fluid cell 14 will reform when the weight is reduced. Equilibrium is achieved when the forces within the fluid cell, including the pressure of the fluid within the fluid cell multiplied by the area of the fluid cell supporting the load, plus the force provided by the spring bias of the fluid cell equal the weight of the load.

The application of an external load on the fluid cell 14 causes the fluid cell 14 to deform into a compressed form. The fluid cell 14 provides a reforming force which causes the fluid cell 14 to return to its original form when the external load is removed from the fluid cell 14. The fluid cell 14 is a resilient material that can contain a fluid such as air, water or nitrogen. The fluid cell 14 may be formed from plastic or any elastomeric material that may be compression molded. The fluid cells 14 may be formed from foam or be constructed of a non-foam material.

A fluid cell 14 that contains air is an air spring. The air spring 14 may be a cartridge that can be releasably attached, or quickly changed, by insertion and removal from a harnessing system 30. In this manner, if the air spring 14 needs to be changed, it can be done so with a friction slot or quick release mechanism.

Figure 5:
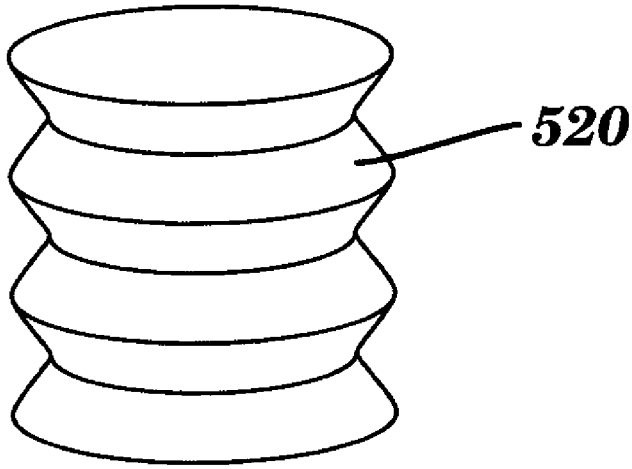
FIG. 5 illustrates a perspective view of a bellows resilient support.

The fluid cell 14 could have an exterior defined by folds along which the fluid cell collapses when loaded as described herein. For example, the fluid cell 14 could be a bellows 520 (FIG. 5) which is formed from a pliable resilient material such as plastic and filled with fluid such as air. The embodiment in FIG. 3 shows a cylindrical fluid cell 14 having a double or twin helix pattern 530. The double helix design 530 controls stability and deflection of the fluid cell 14 such that the fluid cell 14 closely maintains its alignment parallel to its vertical rotational axis 540 during compression and reformation.

Figure 4:
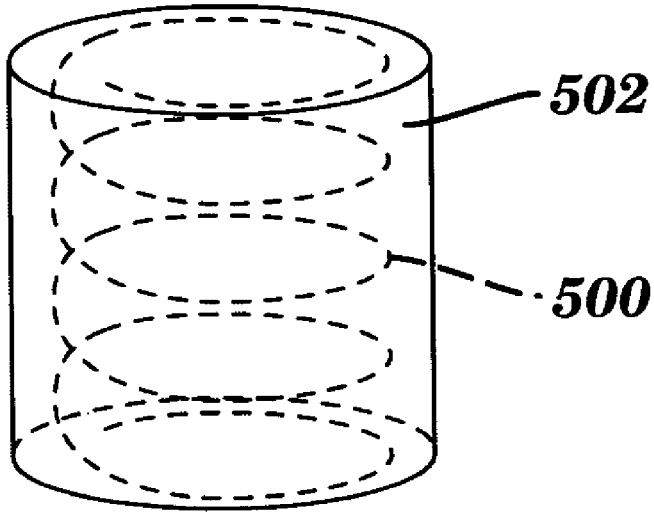
FIG. 4 illustrates a perspective view of a coiled spring resilient support.

The air spring may have an external spring, but may also have an internal spring. The fluid cell 14 could be a coiled spring 500 (FIG. 4) which is surrounded by a resilient material 502 as a surface cover. The surface cover 502 may be fabric, waterproof material, rubber, plastic, moisture wicking material, microfiber, or any material which would resiliently or yieldingly cover the spring and be resiliently or yieldingly supported by the spring 500.

Figure 3C:
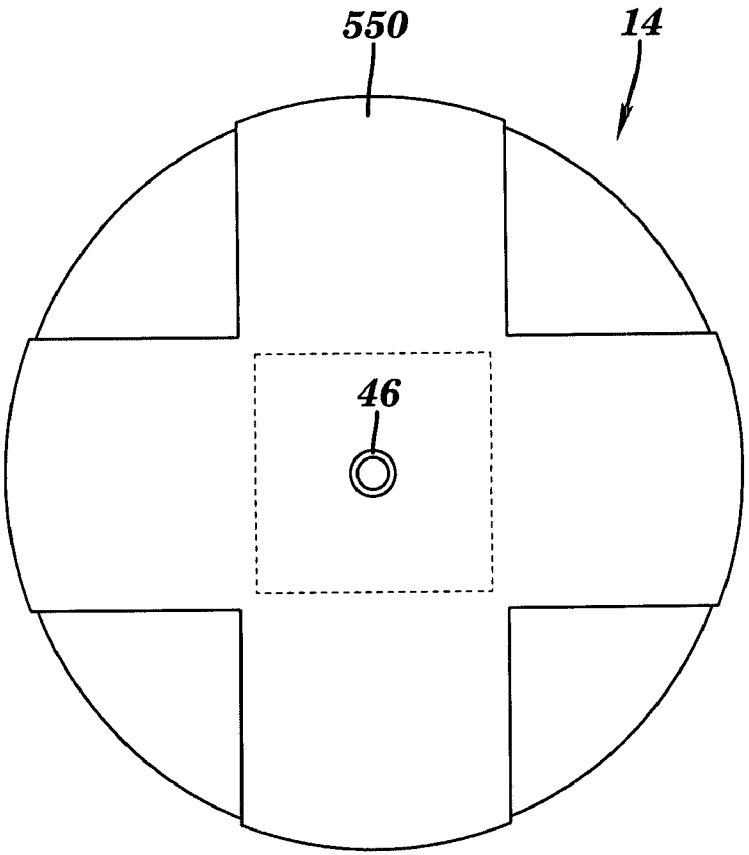
FIG. 3C illustrates the bottom view of one embodiment of a fluid cell including an entrapment device.
Figure 3B:
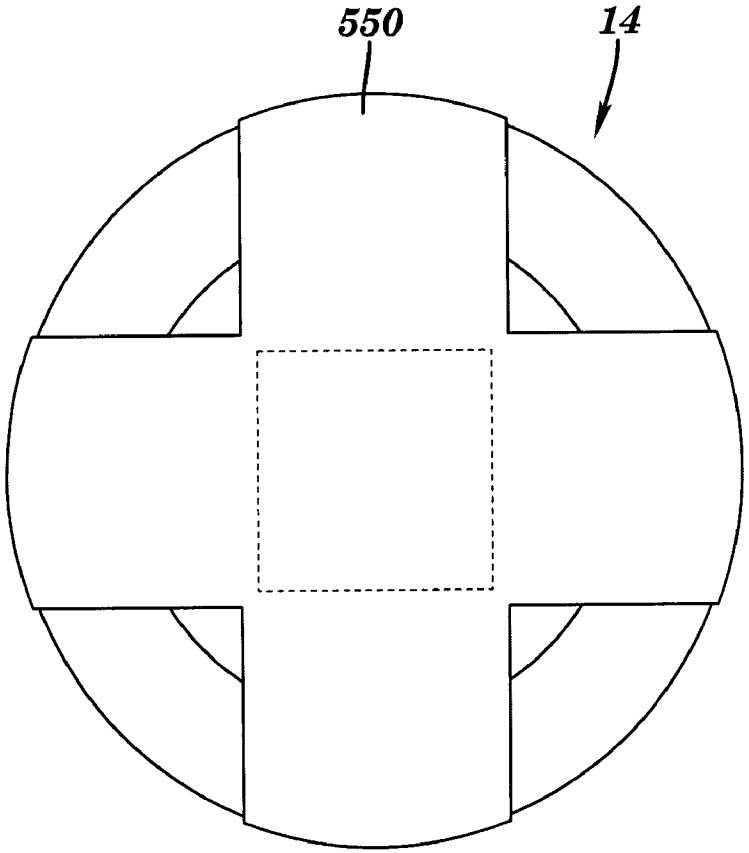
FIG. 3B illustrates the top view of one embodiment of a fluid cell including an entrapment device.

In addition, the fluid cell may be restrained by an entrapment device 550 which restrains the expansion of at least one of the plurality of self-inflating fluid cells 14. An embodiment of an entrapment device is shown in FIGS. 3A, 3B, and 3C. The entrapment device 550 may be a strap constructed of fabric, plastic, rubber, leather, or any material that would restrict the movement of the fluid cell 12. Similarly, the entrapment device 550 may be any device which restricts the expansion of the fluid cell. A body support apparatus 12 may contain one or more fluid cells 14 that are restrained from applying pressure to a body on the body support and some fluid cells 14 that are not restrained, and thus free to be used to manipulate the pressures on the body. Restraining one or more cells would allow the unrestrained cells to adjust more quickly, which would allow the body support 12 to respond more rapidly to changes in pressure.

Figure 10:
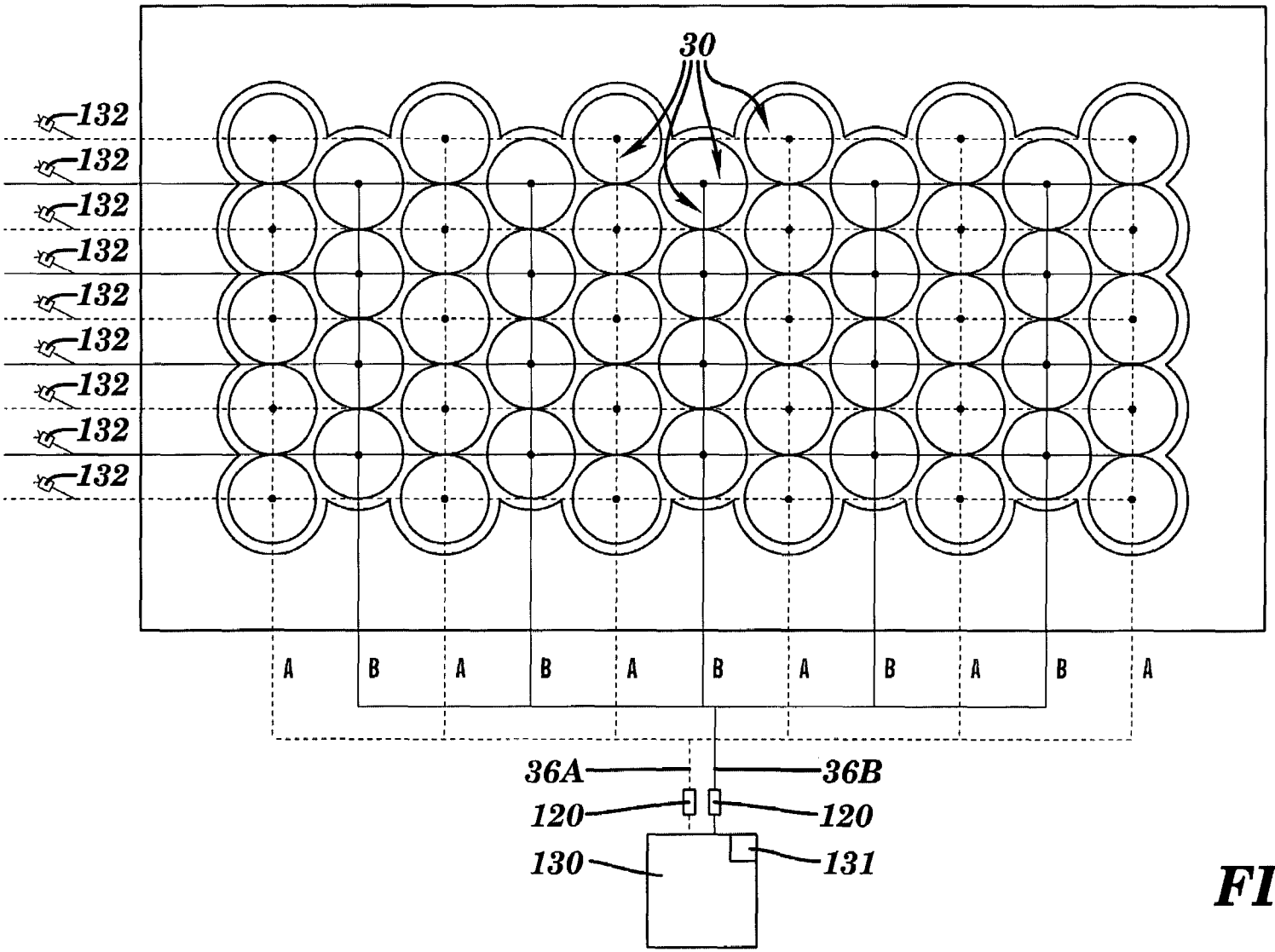
FIG. 10 illustrates a plan view of an embodiment of the harnessing system.

The firmness of the fluid cells can be controlled by the height of the fluid cell 14, the diameter of the fluid cell 14, the wall thickness of the fluid cell 14, the type of resin used to form the fluid cell 14, and the pitch or angle of the helix coupled with the OD and ID radius of the helix. In addition, the harnessing system 30, which allows control of the flow direction and volume, contributes to controlling the firmness of the fluid cells 14. Likewise, as shown in FIG. 10, any pressurized fluid supply 130 or pressure control valve 132 connected to the fluid cells 14 will control the firmness of the fluid cells 14.

Figure 6:
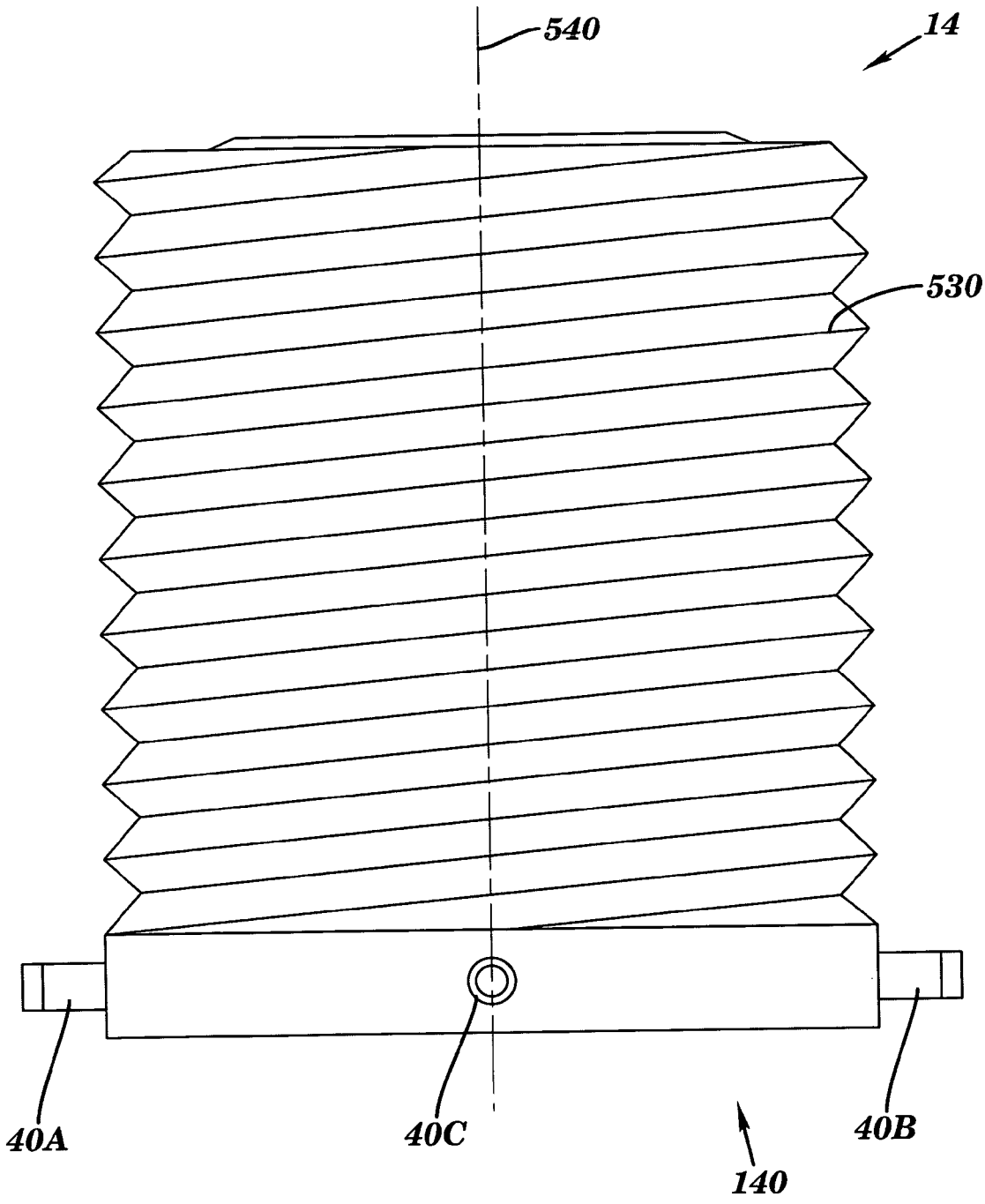
FIG. 6 side view of one embodiment of a fluid cell including the double-helix construction and multiple ports.
Figure 7:
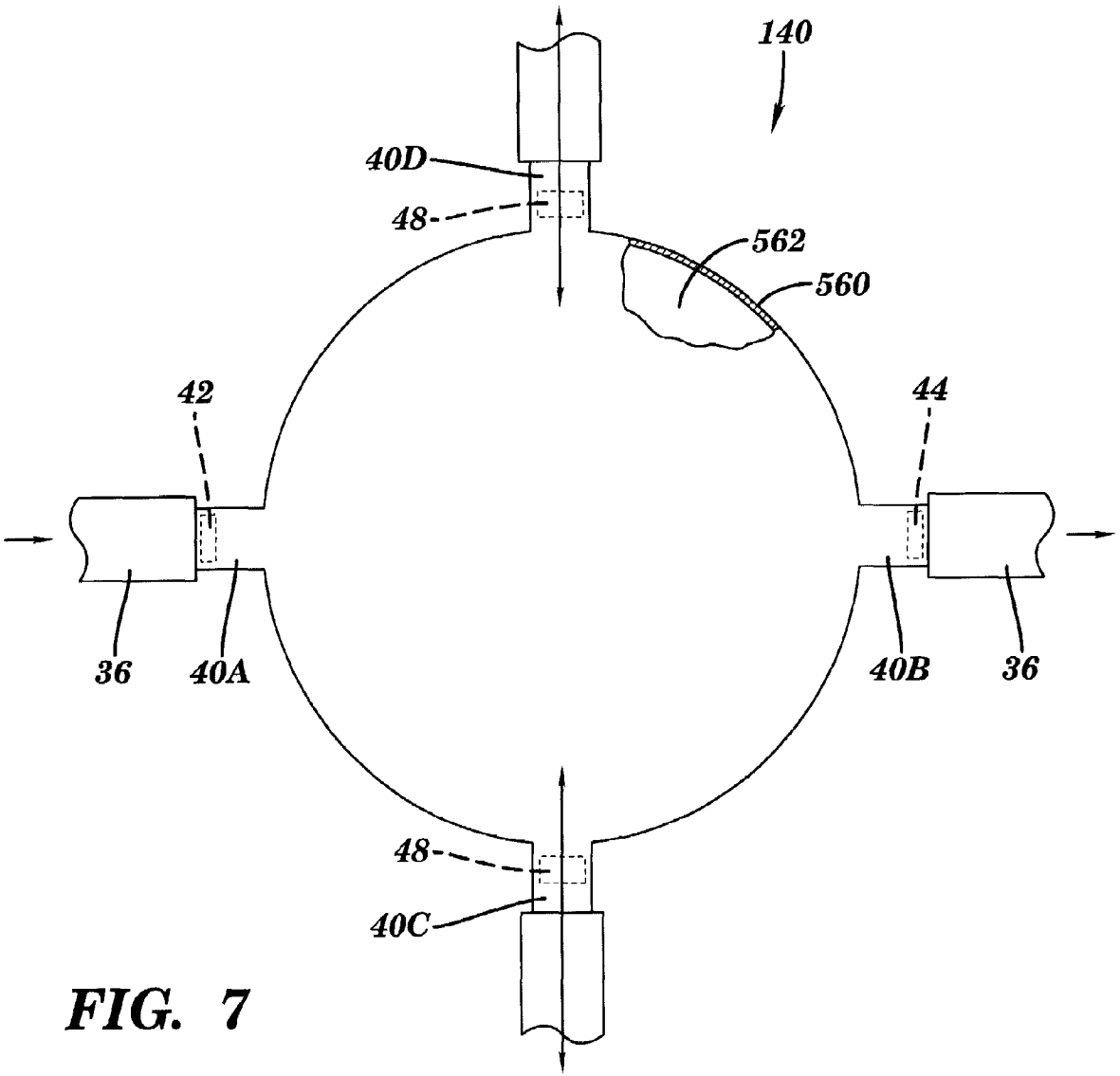
FIG. 7 illustrates a cross sectional view of an embodiment of a fluid cell of the present invention having a multiple port air distribution system including multiple ports.

FIG. 6 and FIG. 7 show that each fluid cell 14 may have a multiple port air distribution system 140 which has multiple connections or ports 40A, 40B, 40C, 40D incorporated in, or integral to, the fluid cell 14 and can control intake flow, outflow, sound and speed of fluid movement. Alternatively, the multiple port air distribution system 140 may be connected to a single port 46 on the fluid cell 14, and include a T-plex, 3-plex, or 4-plex connector which allows the connecting lines which are a part of the harnessing system 30 to be attached to the fluid cell 14 in a variety of configurations. The multiple port air distribution system 140 provides the freedom to direct fluid into selected zones of fluid cells as illustrated in FIGS. 10-13. The multiple port air distribution system 140 has at least two ports 40. One of the ports is an inlet port 40A which may have an intake check valve 42 and the other port is an exhaust port 40B. The intake check valve 42 allows fluid to flow into the fluid cell 14, while preventing fluid from flowing out of the fluid cell 14. A flow restrictor 44 may be included in the exhaust port 40B to control the volume of air flowing through the exhaust port. In addition, the multiple port air distribution system 140 may include one or more ports that allow the bilateral flow of fluid 40C, 40D. These ports may be included on the fluid cell 14 and be capped to prevent fluid exchange if fluid exchange is not desired for that location of the fluid cell 14 in the harnessing configuration. The embodiment shown in FIG. 7 shows four ports: an intake port 40A having a check valve 42, an exhaust port 40B having a flow restrictor 44, and two open ports 40C, 40D which allow the bilateral flow of fluid, in or out of the fluid cell 14. The open ports 40C, 40D may be connected to a constant pressure. Although the ports shown in FIG. 7 are positioned equidistant from each adjacent port, the ports may be positioned at any distance from one another.

FIG. 7 shows that the multiple port air distribution system 140 includes a sound control batten 48 in the ports that allow fluid to flow in either direction 40C, 40D. The sound control batten 48 is for reducing the sound during intake and exhaust of the fluid cell 14. The sound control batten 48 can be reticulated foam, a variegated surface, or any material that would fit within the port or a conduit or connection extending from the port and function to reduce the sound of air movement during intake and exhaust. In addition, the sound control batten 48 may be formed from a flexible or rigid material.

Figure 11:
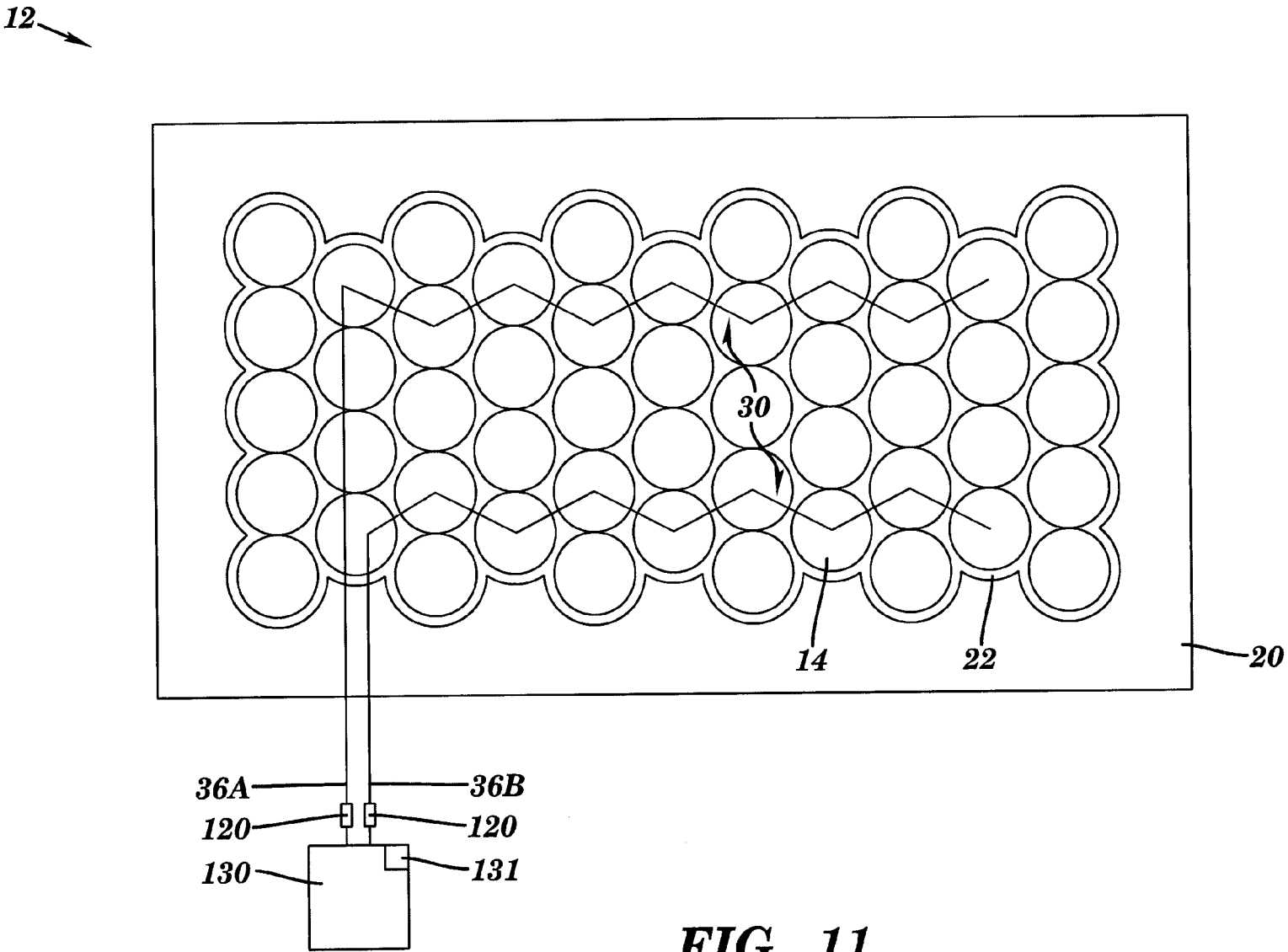
FIG. 11 illustrates a plan view of an embodiment of the fluid cells and harnessing system including an electronic pressure controller.

The body support, or cushioning device 12 includes a harnessing system 30 that controls the direction and flow volume of air into the self-inflating fluid cells 14 such that the pressure in one or a group of the plurality of self-inflating cells may be discretely controlled. Examples of embodiments of the harnessing system 30 of a body support 12 are illustrated in FIGS. 10-13. These embodiments show that the support cells 14 can be inter-connected with one or more networks of connecting lines, or conduits, 36 to provide the support system apparatus 12 with zoned pressure control. FIGS. 10 and 11 show a mattress having a plurality of fluid cells 14 that are interconnected to form support zone "A" and support zone "B." There can be any number of support zones created by a harnessing system 30 which interconnects the fluid cells 14 in a multidirectional pattern achieved by the alignment of the fluid cells 14.

The fluid cells 14 may be rotatable about a vertical axis 540 such that they may rotate in the casing 20 to allow them to be connected with the harnessing system 30 in various harnessing configurations. For example, the fluid cells 14 can be aligned such that the ports 40 are set at a 45 degree angle to the edge of the support apparatus 12 as may be required to interconnect the fluid cells 14 in the harnessing configuration shown in FIG. 11. In addition, the harnessing system 30 may be releasably attached to the fluid cells 14 such that a plurality of harnessing configurations is possible. More specifically, the conduits, or connecting lines, 36 of the harnessing system 30, may be released from the ports 40 to which they are attached in a first harnessing configuration and reattached to another port on the same or another fluid cell 14 to create a second harnessing configuration.

The harnessing system 30 allows for inflow of air to the fluid cell for reinflation speed and controllable and directional flow of air from the fluid cell 14. FIGS. 10 through 14 indicate embodiments that show various ways that the fluid cells can be interconnected. For example, as shown in FIG. 10, the harnessing system 30 controls and facilitates the directions and flow volume of air into the fluid cells creating selected zones 36A and 36B. Similarly, zones or loops "A" 36A and "B" 36B shown in FIG. 11 are another embodiment of how a group of fluid cells can be interconnected. In FIG. 11, fluid cells are connected on either a series of fluid cells marked "A" or a series of fluid cells marked "B." All the series marked "A" can be tied, or manifolded together and the series marked "B" can be separately tied, or manifolded together. The series can be tied together using conduits 36 between the exhaust port 40B and intake port 40A of adjacent fluid cells 14 in the same series. In addition, the open ports 40C, 40D may be manifolded or connected together in a similar manner. The fluid cells 14 can also be joined using a tube, flexible joint, manifold, conduit, or be molded together. The intake port 40A of at least one fluid cell 14 in the series is connected to an intake conduit 36, which may be ambient air or a pressurized air supply. There can be any number of series, each one creating a support zone, or pressure zone.

FIG. 10 also shows that in addition to zoned pressure control, the fluid cells 14 can be inter-connected to provide the body support 12 with alternating pressure support and movement to a person lying on the body support 12. An electronic pressure control system 130 attached to the harnessing system 30 allows for selective manipulation of the fluid cells via selective supply of fluid pressure to the pressure zones. The computerized control system, or pressure control system 131 included in the electronic pressure controller 130 may be programmed by a user to supply alternating pressures to the network of connecting lines connected to the plurality of the fluid cells 14 in any sequence that is desired by the user. Similarly, the computerized control system 131 may allow for a user to select a first sequence for one patient and a second sequence for a second patient. The computerized control system 131 may allow a user to create new sequences customized to accommodate the needs of a patient. The pressure control system 131 may also apply pressure randomly to the pressure zones.

The harnessing system 30 may be powered, but may also be non-powered, free of expensive blowers, pumps or microprcessors. By configuring the harnessing system such that the cells are in all the zones are allowed to equalize to an identical pressure, in the event of turning off or the failure of the pressurized fluid supply, the patient will be slowly and safely lowered to a stable level position.

Figure 12:
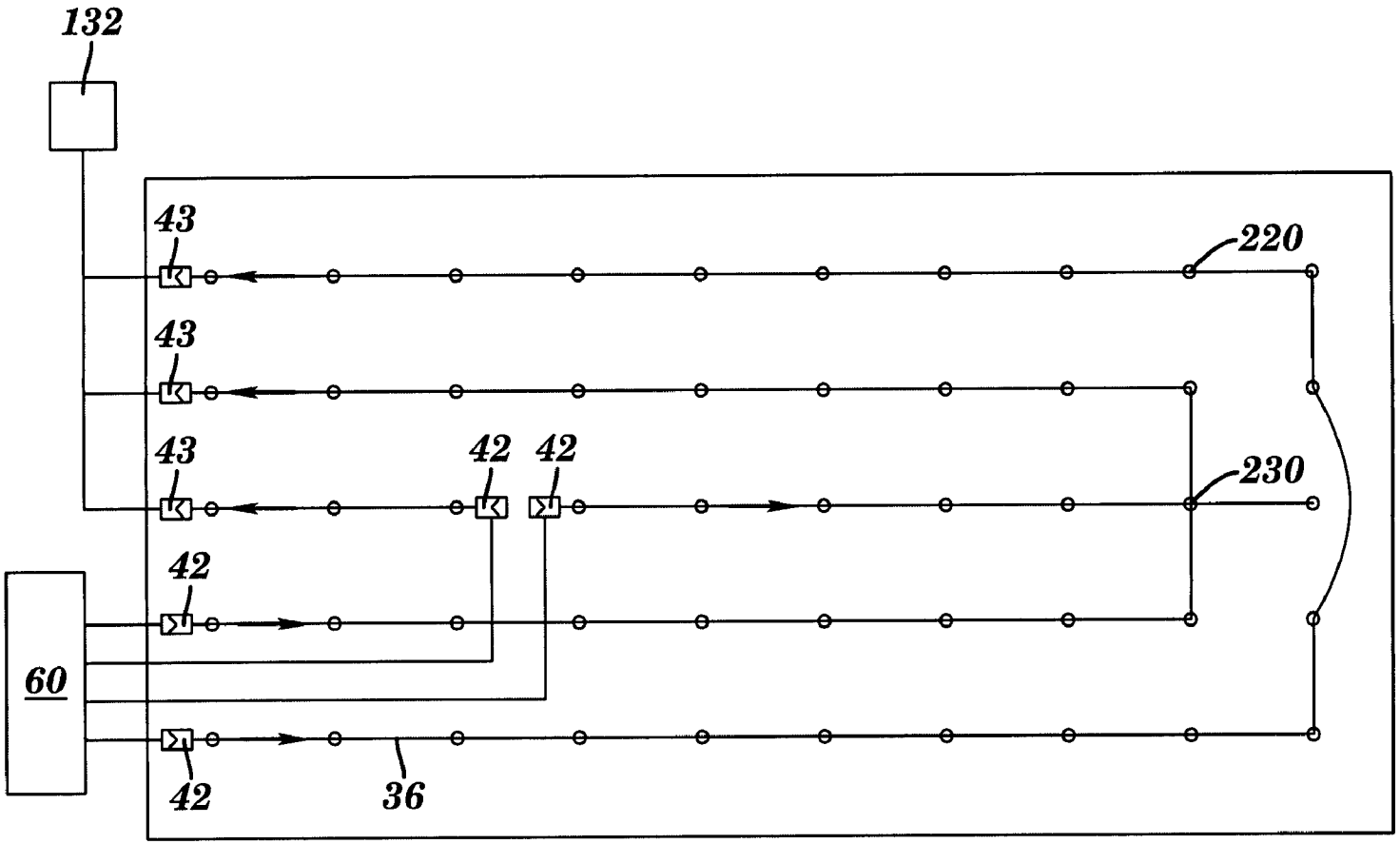
FIG. 12 illustrates a bottom view of one embodiment of the fluid cells and harnessing system including an electronic pressure controller and an exhaust control system.

One embodiment of the present invention is illustrated in FIG. 12. A fluid supply reservoir 60 is available to supply fluid to the self-inflating fluid cells 14. The fluid supply reservoir 60 may be ambient air or a powered fluid supply. Each self-inflating fluid cell has an inlet port 40A and an exhaust port 40B as shown in FIG. 7 or a single port 46 connected to a T-plex, 3-plex, or 4-plex connector on a connecting line 36. The fluid cells may be connected in series to form one or more pressure zones. A check valve 42 is provided between the fluid supply reservoir 60 and an inlet port 40A of at least one of the self-inflating fluid cells in the pressure zone such that fluid will only be able to flow into the self-inflating fluid cell 14 from the fluid supply reservoir 60 and will not be able to flow back into the fluid supply reservoir 60. A controllable pressure relief valve 132 is operatively attached to the exhaust port 40B of at least one of the fluid cells 14 in each pressure zone. There may be one controllable pressure relief 132 valve to which all the zones are attached, or there may be a separate controllable pressure relief valve 132 for each zone. In addition, a check valve 43 may be located between the exhaust port 40B and the controllable pressure relief valve 132 such that once fluid flows out of the series or zone of fluid cells 14, the fluid may not flow back into that series or zone of fluid cells. Thus, fluid flows from a fluid supply 60 through a check valve 42 on a first fluid cell in a series of fluid cells, and continues though each cell in the series until the pressure in the fluid cells is equal to the pressure set by the controllable pressure relief valve, 132. The fluid cells may be connected, or harnessed, in multiple configurations depending on the needs of the patient. For example, FIG. 12 shows the cells harnessed such that some cells have two ports (220) of the multiple port air distribution system 140 connected to the connecting lines 36 of the harnessing system 30 and one cells has four ports (230) of the multiple port air distribution 140 system connected to the connecting lines 36 of the harnessing system 30. In addition, FIG. 12 shows that some of the fluid cells 14 may be connected to an inlet check valve 42 or an exhaust check valve 43 and some of the fluid cells may contain open ports such as 40C and 40D shown in FIG. 7. The releasability of the harnessing system 30, and the various configurations of the multiple port air distribution system 140 allow the system to be customized for different patients.

Figure 13:
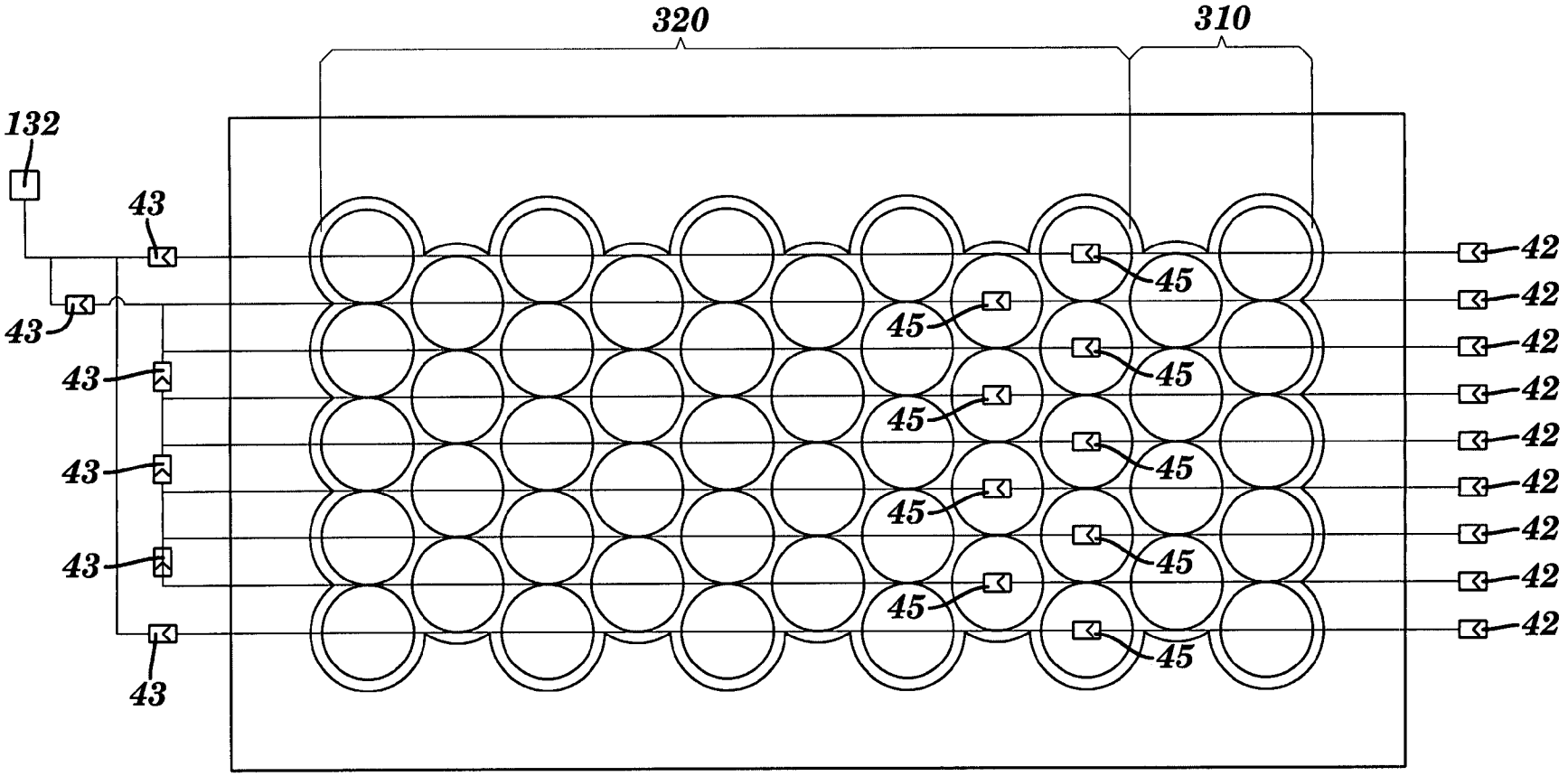
FIG. 13 illustrates a plan view of one embodiment of the fluid cells and harnessing system which allows for manual inflation of the body support.

FIG. 13 shows another example of an embodiment of the present invention. Similar to FIG. 12, the fluid cells are connected in series to form pressure zones. A check valve 42 is provided before the inlet port 40A of at least one of the self-inflating fluid cells 14 in the pressure zone. A controllable pressure relief valve 132 is operatively attached to the exhaust port 40B of at least one of the fluid cells 14 in each pressure zone. There may be one controllable pressure relief 132 valve to which all the zones are attached, or there may be a separate controllable pressure relief valve 131 for each zone (FIG. 10). A check valve 43 is located between the exhaust port 40B and the controllable pressure relief valve 132 such that once fluid flows out of the series, or zone of fluid cells, the fluid may not flow back into the zone of fluid cells. In addition, FIG. 13 shows that a third check valve, also an inlet port check valve 45, may be placed in the middle of a series of fluid cells to create a first zone 310 of fluid cells located on the foot end, or first side, of the body support 12 and a second zone of fluid cells 320 located on the head end, or second side, of the body support 14. The third check valve 45 allows air to flow from the first zone of fluid cells to the second zone of cells and prevents air from flowing from the second zone of fluid cells to the first zone of fluid cells 14. Although FIG. 13 shows three check valves in the series, any number of check valves may be included within the series of fluid cells. The embodiment illustrated in FIG. 13 allows for manual inflation of the body support. When a user sits on the first end 310 of the body support, the second end 320 of the body support is inflated because the air from the first end 310 is forced into the second end 320 and prevented from returning to the first end 310.

An example of a support system apparatus 12 for a mattress includes a plurality of fluid cells 14A, 14B, 14C, 14D, 14E, 14F, 14G, 14H, 14I, 14J, 14K, 14L, 14M, 14N, and 14O as is illustrated in FIG. 2. The fluid cells 614 are held together by a holding mechanism or base housing 20 which is adapted to receive the fluid cells. The base housing may be a foam casing, plastic webbing, or any configuration that affixes the fluid cells together to form a mattress, seat, or sofa construct. FIG. 2 shows a base housing 20 that is a foam casing including bays 22 for receiving the fluid cells 14. The base housing 20 is composed of air or foam or other porous or non-porous materials. The base housing 20 functions as a fluid cell receiver and is a means of affixing the fluid cells 14 together to form a mattress or other body support construct. The base housing 20 provides fluid cell 14 stability by utilizing variable heights of the base, by altering the ILD, density and air pressure of the mass of the base housing (not limited to foam), and the relationship of base material to the number of fluid cells 14 in a given area. The base housing supports, houses, and prevents movement of the fluid cells 614 and the harnessing system 30.

Figure 8:
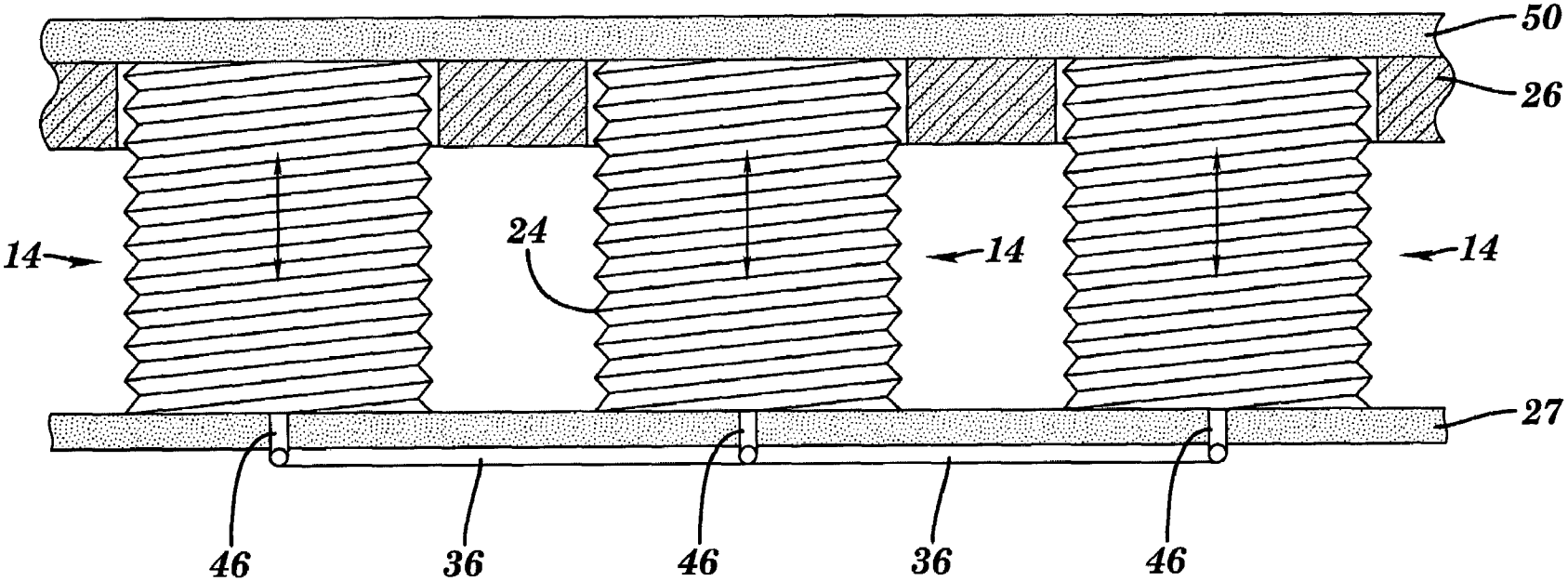
FIG. 8 illustrates a cross sectional view of the support system apparatus of an embodiment of the present invention, including the fluid cells, casing, conduits, and a topper cushion which rests on top of the casing.
Figure 9:
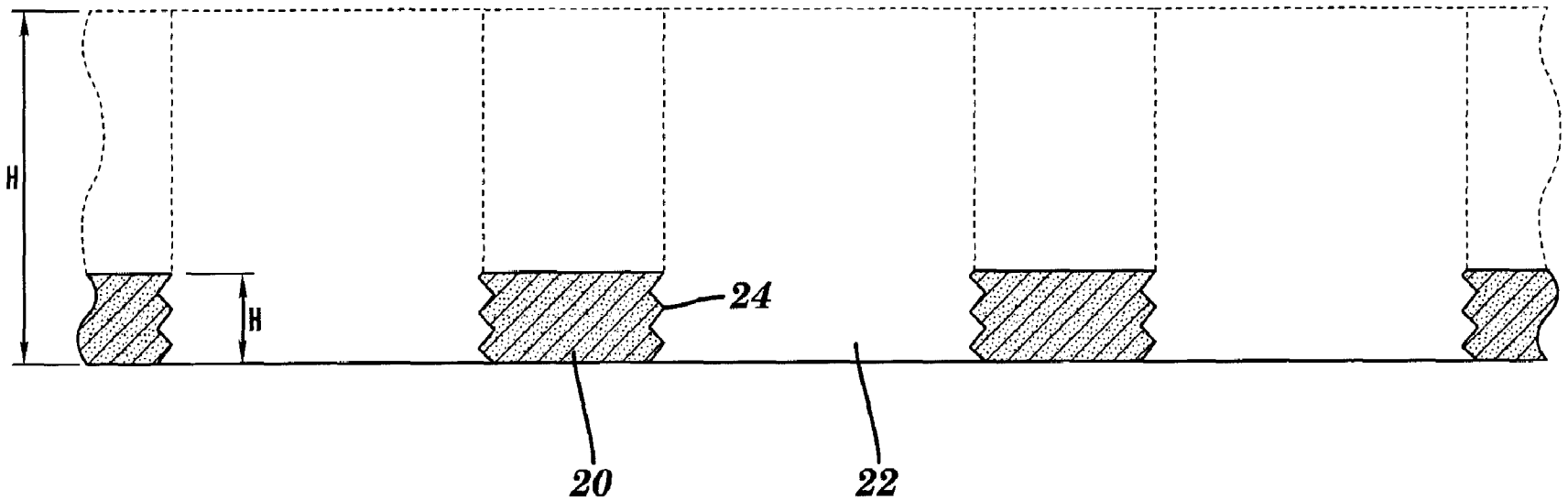
FIG. 9 illustrates a side view of an embodiment of the casing.

FIG. 8 shows a side view of the base housing 20 with the fluid cells 14 installed, and FIG. 9 shows a side view of the base housing 20 without the fluid cells 14 installed. Dotted lines indicate that the base housing 20 in the foam embodiment of FIG. 9 can be made of various heights (H). For example, the fluid cells 14 can extend vertically significantly higher than the base housing. Conversely, as shown in FIG. 2, the base housing foam 20 can extend vertically up to, or near to, the same height as the fluid cell 14. In order to hold the fluid cell 14 within the base housing 20, the base housing 20 can include threaded constructs 24 (FIG. 9) in various openings to receive a threaded (i.e., helical) exterior of the fluid cells 14.

FIG. 1 shows another embodiment of a casing 20 having a plurality of pads. At least one of the pads, in this embodiment the top pad, or first pad, 26, is adapted to accept the plurality of fluid cells. For example, as shown in FIG. 1, the pad includes openings or bays 22 that generally conform to the shape of the fluid cells 14 and secure the fluid cells 14 during use of the apparatus 12. The casing 20 may have one or more side walls 28, and a bottom pad, or second pad 27 located on a separate side of the fluid cells 14 than the top pad, or first pad, 26.

FIG. 2 shows that the support system apparatus 12 has a topper cushion 50 and an outer cover 52. The topper cushion 50 rests above of the fluid cells 14 and base housing 20 to provide further cushioning. The topper cushion 50 may be formed from a layered fiber filled material, foam, wool, a moisture wicking material, or any other suitable material that provides cushioning. The base housing 20, fluid cells 14, harnessing system 30, and topper cushion 50 are contained by an outer cover 52 which has a low friction and low shear surface for further protecting the patient from frictional tissue damage. Additionally, the outer cover 52 provides a waterproof and stain resistant surface. The outer cover 52 can be expandable, waterproof, or moisture wicking. For medical uses, the outer cover 52 can be made from an anti-microbial type material.

The foregoing description of the present invention has been presented for purposes of illustration and description. It is not intended to be exhaustive or to limit the invention to the precise form disclosed, and many modifications and variations are possible in light of the above teaching. For example, the cushioning device of the present invention is suitable for providing discrete manipulation of the pressure on a body, which is customizable by a user to meet the needs of a particular patient. Also, the cushioning device of the present invention is suitable for any application where low interface pressure is required between the cushioning device and the surface of the body being supported. Such modifications and variations that may be apparent to a person skilled in the art are intended to be included within the scope of this invention as defined by the accompanying claims.

Appendix A

Appendix A includes calculations related to the properties of the air leaving and entering the fluid cells.

Appendix A

Variables affecting velocity of air leaving air cell:
Volume (V)
Pressure (P)
Temperature (T)
Force of patient on air cell ($F_W$)
Spring Force ($F_S$)
Spring Constant (k)
Area of escape Valves (a)
Number of valves open (v)

*The square root of the sum of the forces times the area of the escape valves divided by the weight acting on the air cell is equal to the average velocity of the air leaving the cell.

$$((\Sigma F \times \text{area})/\text{weight})=v$$

Force of Weight of patient+Force of Pressure inside the air cell−Force of Spring=Sum of the Forces $$F_W+F_P-F_S=\Sigma F$$

Force of Spring is equal to the spring constant times the distance it is from equilibrium.

$$F_S=-k\,d$$

The Spring constant depends on the type of material, and the shape of the spring. It lessens with time and use.

Volume is equal to the number of moles of air in the cell times the gas constant (R) times the absolute temperature of the cell all over the pressure in the cell.

$$V=(nRT)/P$$

Absolute temperature is the number of degrees above absolute zero.

The area of the escape valves is equal to pi times the radius squared times the number of open valves.

$$A_{valves}=\Pi r^2 v$$

What is claimed is:

1. A body support apparatus for discrete manipulation of pressure on a body comprising:
   a plurality of self-inflating fluid cells affixed together to form a support surface, wherein each of said plurality of self-inflating fluid cells has at least one port, an exterior, and an interior, and wherein said interior is defined by an open area for receiving fluid; and
   a harnessing system that controls the direction and flow volume of fluid into the self-inflating fluid cells such that the pressure in one or a group of the plurality of self-inflating cells may be discretely controlled, and
   an intake check valve operatively attached to said plurality of self inflating cells, wherein said body support apparatus remains functional by providing even patient support when non-powered by allowing all of said plurality of self-inflating fluid cells to equalize to an identical pressure by fluid flow through said ports interconnecting the plurality of cells.

2. The body support apparatus of claim 1, wherein each of said plurality of self-inflating fluid cells is a reforming element that collapses when loaded with a load having a force which is greater than the sum of the forces within the self-inflating fluid cell, including the pressure of the fluid inside the self-inflating fluid cell multiplied by the area of the self-inflating fluid cell supporting the load, plus the reforming force of the self-inflating fluid cell, and said self-inflating fluid cell reforms when said load is reduced to a load having a force which is less than the sum of the forces within the self-inflating fluid cell and the reforming force of the self-inflating fluid cell.

3. The body support apparatus of claim 1, wherein said harnessing system is releasably attached to said at least one port of said plurality of self-inflating fluid cells and may be releasably attached to said at least one port of said plurality of self-inflating fluid cells in a plurality of harnessing configurations.

4. The body support apparatus of claim 1, wherein the harnessing system includes a plurality of networks of connecting lines which create a plurality of pressure zones.

5. The body support apparatus of claim 1, wherein said harnessing system is non-powered.

6. The body support apparatus of claim 1, further comprising means for supplying fluid to said harnessing system.

7. The body support apparatus of claim 1, wherein said self-inflating fluid cells are cylindrical.

8. The body support apparatus of claim 1, wherein said self-inflating fluid cells have a helical pattern on the outer construct such that said self-inflating fluid cells collapse when loaded with force which is greater than the sum of the force of pressure inside the self-inflating fluid cell and the reforming force of the self-inflating fluid cell and inherently expand when the load is reduced.

9. The body support apparatus of claim 1, wherein said self-inflating fluid cells are releasably attached to said harnessing system.

10. The body support apparatus of claim 1, further comprising an entrapment device which restrains the expansion of at least one of the plurality of self-inflating fluid cells.

11. The body support apparatus of claim 1, wherein said self-inflating fluid cells are formed of molded plastic.

12. The body support apparatus of claim 1, further comprising:

a casing which accepts said self-inflating fluid cells and affixes said self-inflating fluid cells together to form at least one of a mattress, seat, or sofa construct.

13. The body support apparatus of claim 12, wherein said casing is plastic.

14. The body support apparatus of claim 12, wherein said casing is foam.

15. The body support apparatus of claim 12, wherein said casing includes bays for accepting said self-inflating fluid cells.

16. The body support apparatus of claim 15 wherein said bays include threaded constructs to receive a self-inflating fluid cell having corresponding threads.

17. The body support apparatus of claim 12 further including a topper positioned above the cells to provide further cushioning.

18. The body support apparatus of claim 17, wherein the topper is wool.

19. The body support apparatus of claim 18, further including an outer cover having a low friction and low shear surface.

20. The body support apparatus of claim 19, wherein the outer cover is expandable.

21. The body support apparatus of claim 1, wherein said at least one port includes a sound control batten for reducing the sound during intake and exhaust of the fluid cell.

22. The body support apparatus of claim 21, wherein the sound control batten is reticulated foam.

23. The body support apparatus of claim 21, wherein the sound control batten is a variegated surface.

24. The body support apparatus of claim 21, wherein the sound control batten is selected from the group consisting of flexible material and rigid material.

25. The body support apparatus of claim 1, further comprising an electronic pressure control system for selective manipulation of said self-inflating fluid cells, wherein said electronic pressure controller is attached to said harnessing system.

26. The body support apparatus of claim 1, wherein said self-inflating fluid cells are not constructed of foam.

27. The body support apparatus of claim 1, wherein said self-inflating fluid cells are selected from the group consisting of single helix springs, twin helix springs, and bellows.

28. A method of manipulating the pressure on a body comprising:

providing a support apparatus according to claim 1 further having a plurality of molded air springs, wherein each of said molded air springs has an exterior configured to reform said molded air spring;

attaching a harnessing system to said plurality of molded air springs, wherein said harnessing system includes conduits that interconnect the plurality of molded air springs to create a first harnessing configuration, wherein said first harnessing configuration includes a plurality of pressure zones; and selectively manipulating the pressure on a body on the support apparatus by selectively filling at least one of said plurality of pressure zones.

29. The method of manipulating the pressure on a body of claim 28 further comprising:

releasing any one of said conduits of said harnessing system from said molded air spring; and attaching said any one of said conduits to any one of said molded air springs to create a second harnessing configuration.

30. The method of manipulating the pressure on a body of claim 28 further comprising; providing an electronic pressure control system for selectively supplying fluid pressure to the plurality of pressure zones.

31. The method of manipulating the pressure on a body of claim 28, further comprising:

sequentially applying pressure to said plurality of pressure zones.

32. The method of manipulating the pressure on a body of claim 28, further comprising: providing a casing adapted to receive said molded air springs.

33. The method of manipulating the pressure on a body of claim 28, further comprising:

providing a fluid supply reservoir; providing an inlet port and an exhaust port for each molded air spring;

attaching a first check valve between said fluid supply reservoir and an inlet port of at least one of said molded air springs in each of said plurality of pressure zones, such that fluid will only be able to flow into said molded air spring; providing a controllable pressure relief valve, wherein said controllable pressure relief valve is operatively attached to the exhaust port of at least one molded air spring in each of said plurality of pressure zones.

34. The method of manipulating the pressure on a body of claim 28, further comprising:

providing a first zone of molded air springs and second zone of molded air springs; and attaching a third check valve between said first zone of molded air springs and said second zone of molded air springs such that air may flow from said first zone of molded air springs to said second zone of molded air springs and air is prevented from flowing from said second zone of molded air springs into said first zone of molded air springs.

35. A body support apparatus for discrete manipulation of the pressure on a body comprising:

a plurality of non-foam cartridges that are self-inflating;

a multiple port air distribution system for each non-foam cartridge including at least two ports;

an intake check valve on each non-foam cartridge;

a casing adapted to receive said fluid cell, wherein said casing affixes said non-foam cartridges together to form a support surface;

a harnessing system that controls the direction and flow volume of air into the non-foam cartridges, wherein said harnessing system is attached to the multiple port air distribution system of each of said non-foam cartridges of said plurality of non-foam cartridges and wherein said body support apparatus remains functional when non-powered to provide patient support by equalizing to an identical pressure by fluid flow through said ports interconnecting the plurality of cells.

36. The body support apparatus of claim 35, wherein one of said at least two ports is an inlet port having said check valce and another of said at least two ports is an exhaust port.

37. The body support apparatus of claim 36, further comprising:

a flow restrictor, wherein said flow restrictor controls the volume of air flowing through said exhaust port.

38. The body support apparatus of claim 35, wherein said multiple port air distribution system includes at least one intake port and at least one port that allows the bilateral flow of fluid.

39. The body support apparatus of claim 35, wherein said multiple port air distribution system includes three ports.

40. The body support appatatus of claim 35, wherein said multiple port air distribution system includes four ports.

41. The body support apparatus of claim 35, wherein a first of said at least two ports is in an inlet port having said check valve, a second of said at least two ports is an exhaust port, and a third and fourth of said at least two ports allow the bilateral flow of fluid and are connected to constant pressure.

42. The body support apparatus of claim 35, wherein said multiple port air distribution system is integral to said non-foam cartridge.

43. The body support apparatus of claim 35, wherein said multiple port air distribution system is attached to a single port on said non-foam cartridge and further includes a connector creating at least two ports that can be attached to said harnessing system.

44. The body support apparatus od claim 35, wherein said non-foam cartridges are cylindrical.

45. The body support apparatus of claim 35, wherein said non-foam cartridges have a helical pattern on the outer construct such that said each of said non-foam cartridges collapse when loaded with force which is greater than the sum of the force of pressure inside the non-foam cartridge and the reforming force of the non-foam cartridge and inherently expand when the load is reduced.

46. The body support apparatus of claim 35, wherein said non-foam cartridges are releasably attached to said harnessing system.

47. The body support apparatus of claim 35, further comprising an entrapment device which restrains the expansion of at least one of the plurality of non-foam cartridges.

48. The body support apparatus of claim 35, wherein said non-foam cartridges are formed of molded plastic.

49. The body support apparatus of claim 35, further comprising:

means for supplying fluid to said harnessing system.

50. The body support apparatus of claim 35, wherein said casing is foam.

51. The cushioning device of claim 35 wherein said casing further comprises:

a first pad having bays for accepting said non-foam cartridges.

52. The cushioning device of claim 51 wherein said casing further comprises:

at least one pad located on a separate side of said plurality of non-foam cartridges than said first pad.

53. The body support apparatus of claim 35, wherein said casing is plastic.

54. The body support apparatus of claim 35, wherein said harnessing system is non-powered.

55. The body support apparatus of claim 35, wherein the harnessing system includes a plurality of networks of connecting lines and wherein said connecting lines attach to said ports of said multiple port air distribution system to create a plurality of pressure zones.

56. The body support apparatus of claim 35, further including an outer cover having a low friction and low shear surface.

57. The body support apparatus of claim 56, wherein the outer cover is expandable.

58. The body support apparatus of claim 35, wherein the multiple port air distribution system includes a sound control batten for reducing the sound during intake and exhaust of the non-foam cartridge.

59. The body support apparatus of claim 58, wherein the sound control batten is reticulated foam.

60. The body support apparatus of claim 58, wherein the sound control batten is a variegated surface.

61. The body support apparatus of claim 58, wherein the sound control batten is selected from the group consisting of flexible material and rigid material.

62. The body support apparatus of claim 35, wherein said non-foam cartridges are selected from the group consisting of single helix springs, twin helix springs, and bellows.

63. The body support apparatus of claim 35, further comprising: a pressure control system for selective manipulation of said non-foam cartridges, wherein said pressure control system is attached to said harnessing system.

64. The body support apparatus of claim 35, further comprising: an pressure control system applying alternating fluid pressure to the network of connecting lines.

65. The body support apparatus of claim 35, further comprising: a pressure control system which applies pressure sequentially to said pressure zones.

66. The body support apparatus of claim 35, further comprising: a pressure control system which applies pressure randomly to said pressure zones.

67. The body support apparatus of claim 35, further including a topper positioned above the non-foam cartridges to provide further cushioning.

68. A cushioning device comprising:

a plurality of air springs, each of said air springs having an exterior, an interior, an inlet port and an exhaust port, wherein said interior is defined by an open space for receiving fluid, and wherein said exterior has a bias to reform said air spring;

a flow restrictor in said exhaust port to control flow of said fluid;

at least one port on each air spring to allow bilateral flow to an adjacent air spring;

a fluid supply;

a check valve between said fluid supply and said inlet port of at least one of said air springs, such that fluid will only be able to flow into said air spring.

69. The cushioning device of claim 68 further comprising:

providing a casing adapted to receive said air springs.

70. The cushioning device of claim 68 further comprising: a third check valve between said first zone of air springs and said second zone of air springs such that air may flow from said first zone of cells to said second zone of cells and air is prevented from flowing from said second zone of cells into said first zone of cells.

71. The cushioning device of claim 68, further comprising: a fluid pressure source operatively connected to said air springs.

72. The cushioning device of claim 68 further comprising: a controllable pressure relief valve, wherein said controllable pressure relief valve is operatively attached to the exhaust port of at least one air spring in each of said plurality of pressure zones; a second check valve between said exhaust port and said controllable pressure relief valve, such that fluid is prevented from entering said exhaust port; and a pressure control system which allows for individual manipulation of said support zones.

* * * * *

UNITED STATES PATENT AND TRADEMARK OFFICE

CERTIFICATE OF CORRECTION

PATENT NO. : 7,434,283 B2
APPLICATION NO. : 11/056686
DATED : October 14, 2008
INVENTOR(S) : John W. Wilkinson et al.

It is certified that error appears in the above-identified patent and that said Letters Patent is hereby corrected as shown below:

Column 7
Line 48, delete “prcessors” and insert -- processors --

Column 8
Line 11, delete “though” and insert -- through --
Line 18, delete “cells” and insert -- cell --

Column 13
Line 9, insert the word -- and -- after “surface;”
Line 20, delete “valce” and insert -- valve --
Line 34, delete “a” and insert -- said --
Line 35, delete “having said” and insert -- having a --
Line 48, delete “od” and insert -- of --

Column 14
Line 43, delete “an” and insert -- a --

Signed and Sealed this

Ninth Day of December, 2008

JON W. DUDAS
*Director of the United States Patent and Trademark Office*